US010829936B2

(12) United States Patent
Grubka et al.

(10) Patent No.: US 10,829,936 B2
(45) Date of Patent: Nov. 10, 2020

(54) HIP AND RIDGE SHINGLE

(71) Applicant: Owens Corning Intellectual Capital, LLC, Toledo, OH (US)

(72) Inventors: Lawrence J. Grubka, Westerville, OH (US); Christina Marie Wise, Granville, OH (US); John Allen Thies, III, Eden Prairie, MN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 16/220,504

(22) Filed: Dec. 14, 2018

(65) Prior Publication Data

US 2019/0119916 A1 Apr. 25, 2019

Related U.S. Application Data

(63) Continuation of application No. 15/719,074, filed on Sep. 28, 2017, now abandoned.

(60) Provisional application No. 62/400,667, filed on Sep. 28, 2016.

(51) Int. Cl.
*E04D 1/30* (2006.01)

(52) U.S. Cl.
CPC ..... *E04D 1/30* (2013.01); *E04D 2001/304* (2013.01); *E04D 2001/305* (2013.01)

(58) Field of Classification Search
CPC ..... E04D 1/30; E04D 2001/304; E04D 2001/305
See application file for complete search history.

(56) References Cited

U.S. PATENT DOCUMENTS

| | | | | |
|---|---|---|---|---|
| 4,274,243 | A * | 6/1981 | Corbin | D06N 5/00 156/264 |
| 6,748,714 | B2 | 6/2004 | Elliott | |
| 7,877,949 | B1 | 2/2011 | Elliott | |
| 8,006,457 | B2 | 8/2011 | Binkley et al. | |
| 8,057,148 | B2 | 11/2011 | Binkley et al. | |
| 8,127,514 | B2 | 3/2012 | Binkley et al. | |
| 8,156,704 | B2 | 4/2012 | Belt et al. | |
| 8,173,243 | B2 | 5/2012 | Kalkanoglu et al. | |
| 8,181,413 | B2 | 5/2012 | Belt et al. | |
| 8,240,100 | B2 | 8/2012 | Kalkanoglu et al. | |
| 8,240,101 | B2 | 8/2012 | Binkley et al. | |
| 8,240,102 | B2 | 8/2012 | Belt et al. | |
| 8,316,608 | B2 | 11/2012 | Binkley et al. | |
| 8,383,228 | B2 | 2/2013 | Kalkanoglu et al. | |

(Continued)

OTHER PUBLICATIONS

Office Action from U.S. Appl. No. 15/719,074 dated Jan. 25, 2018.

*Primary Examiner* — Andrew J Triggs
(74) *Attorney, Agent, or Firm* — Calfee, Halter & Griswold LLP

(57) ABSTRACT

An exemplary laminated shingle includes an overlay sheet having a top overlay surface, a bottom overlay surface, a headlap portion, and a tab portion arranged between two-cutouts. The shingle also includes an underlay sheet having a top underlay surface and a bottom underlay surface. The overlay sheet is attached to the underlay sheet such that a portion of the top underlay surface is exposed on a first side of the tab portion and a portion of the top underlay surface is exposed on a second side of the tab portion.

20 Claims, 10 Drawing Sheets

(56) References Cited

U.S. PATENT DOCUMENTS 8,397,460 B2 * 3/2013 Rodrigues ..... B32B 3/06 52/557
8,409,689 B2 4/2013 Kalkanoglu et al.
8,430,983 B2 4/2013 Vermilion et al.
8,438,812 B2 5/2013 King et al.
8,592,025 B2 11/2013 Kalkanoglu et al.
8,607,521 B2 12/2013 Belt et al.
8,615,968 B2 12/2013 Kalkanoglu et al.
8,623,164 B2 1/2014 Belt et al.
8,752,351 B2 6/2014 Belt et al.
8,776,471 B2 7/2014 Jenkins et al.
8,793,955 B2 8/2014 Ray et al.
8,813,453 B2 8/2014 Kalkanoglu et al.
8,959,876 B2 2/2015 Kalkanoglu et al.
8,984,835 B2 3/2015 Kalkanoglu et al.
8,991,130 B2 3/2015 Belt et al.
9,017,791 B2 * 4/2015 Grubka ..... E04D 1/20 428/136
9,121,178 B2 9/2015 Belt et al.
9,140,012 B1 9/2015 Leitch et al.
9,169,645 B1 10/2015 Kalkanoglu et al.
9,187,903 B1 11/2015 Buzza
9,279,255 B2 3/2016 Bryson et al.
9,290,945 B2 3/2016 Beerer et al.
9,353,526 B2 5/2016 Kalkanoglu et al.
RE46,177 E 10/2016 Vermilion et al.
9,464,439 B2 10/2016 Buzza
9,605,434 B2 3/2017 Belt et al.
9,624,670 B2 4/2017 Belt et al.
9,657,478 B2 5/2017 Belt et al.
9,657,479 B2 5/2017 Kalkanoglu et al.
9,739,062 B2 8/2017 Leitch
9,758,970 B2 * 9/2017 Grubka ..... E04D 1/20
2001/0049002 A1 12/2001 McCumber et al.
2003/0032356 A1 2/2003 Kiik et al.
2003/0040241 A1 2/2003 Kiik et al.
2003/0138601 A1 7/2003 Elliott
2003/0172611 A1 * 9/2003 Coco ..... E04D 1/26 52/554
2004/0055240 A1 3/2004 Kiik et al.
2004/0055241 A1 3/2004 Railkar
2004/0083674 A1 5/2004 Kalkanoglu et al.
2004/0103611 A1 6/2004 King et al.
2004/0107664 A1 6/2004 Rodrigues
2004/0123537 A1 7/2004 Elliott et al.
2004/0123543 A1 7/2004 Elliott et al.
2004/0123545 A1 7/2004 Phillips
2004/0258883 A1 12/2004 Weaver
2005/0193673 A1 9/2005 Rodrigues et al.
2005/0284070 A1 12/2005 Binkley et al.
2006/0059834 A1 3/2006 Elliott et al.
2006/0213143 A1 9/2006 McIntyre
2006/0265990 A1 11/2006 Kalkanoglu et al.
2007/0039274 A1 2/2007 Harrington et al.
2007/0042158 A1 * 2/2007 Belt ..... B32B 3/10 428/143
2008/0060307 A1 3/2008 McIntyre
2008/0134612 A1 6/2008 Koschitzky
2009/0229210 A1 9/2009 Binkley et al.
2009/0229211 A1 9/2009 Binkley et al.
2009/0229217 A1 9/2009 Binkley et al.
2009/0293404 A1 12/2009 Belt et al.
2010/0192509 A1 8/2010 Sieling et al.
2010/0205898 A1 8/2010 Rodrigues et al.
2010/0310825 A1 12/2010 Kalkanoglu et al.
2010/0313512 A1 12/2010 Rodrigues et al.
2011/0016812 A1 1/2011 Belt et al.
2011/0139366 A1 6/2011 Belt et al.
2011/0146185 A1 6/2011 Belt et al.
2011/0197534 A1 8/2011 Belt et al.
2011/0232220 A1 9/2011 Belt et al.
2011/0283646 A1 11/2011 Vermilion et al.
2012/0047838 A1 3/2012 Kalkanoglu et al.
2012/0210666 A1 8/2012 Kalkanoglu et al.
2012/0227347 A1 9/2012 Kalkanoglu et al.
2013/0019554 A1 1/2013 Rodrigues et al.
2013/0025224 A1 1/2013 Vermilion et al.
2013/0025225 A1 1/2013 Vermilion et al.
2013/0025226 A1 1/2013 Jenkins et al.
2013/0025768 A1 1/2013 Vermilion et al.
2013/0180196 A1 7/2013 Kalkanoglu et al.
2013/0219819 A1 8/2013 Kalkanoglu et al.
2013/0239506 A1 9/2013 Ray et al.
2014/0053492 A1 2/2014 Kalkanoglu et al.
2014/0102030 A1 4/2014 Belt et al.
2014/0102031 A1 4/2014 Belt et al.
2014/0150365 A1 6/2014 Belt et al.
2014/0260078 A1 9/2014 Bryson et al.
2014/0322494 A1 10/2014 Belt et al.
2014/0325929 A1 11/2014 Vermilion et al.
2015/0240495 A1 8/2015 Vermilion et al.
2015/0292208 A1 10/2015 Kalkanoglu et al.
2015/0315790 A1 11/2015 Buzza
2016/0090742 A1 3/2016 Belt et al.
2016/0145871 A2 5/2016 Buzza
2016/0222664 A1 8/2016 Belt et al.
2016/0222665 A1 8/2016 Belt et al.
2016/0222666 A1 8/2016 Belt et al.
2016/0244971 A1 8/2016 Belt et al.

* cited by examiner

HIP AND RIDGE SHINGLE

CROSS-REFERENCE TO RELATED APPLICATIONS

The present application is a continuation of U.S. Non-Provisional application Ser. No. 15/719,074, filed on Sep. 28, 2017, which claims the benefit of U.S. Provisional Application Ser. No. 62/400,667, filed on Sep. 28, 2016, the disclosures of which are incorporated herein by reference in their entireties.

TECHNICAL FIELD

The present invention relates generally to roof shingles for protecting a roof of a structure, and more particularly, hip and ridge shingles for application on hip or ridge portions of a roof.

BACKGROUND OF THE INVENTION

Many structures have pitched, shingled roofs, which prevent water, e.g., rain water, from entering the structures by causing water to pass over the shingles and shed off the roofs. A pitched, shingled roof has a pitched substrate, such as a plurality of plywood sheets, with a plurality of shingles attached thereto.

Each shingle has an upper portion (i.e., a headlap portion) and a lower portion (i.e., an exposure portion) wherein the exposure portion is exposed to the environment. The shingles are typically attached to the substrate in rows known as courses wherein the exposure portion of an upper course of shingles overlaps the headlap portion of an adjacent lower course of shingles. For example, a first course of shingles may be attached to the substrate nearest the lowest point of the roof, i.e., the eave portion of the roof. A second course of shingles may then be attached to the substrate slightly higher on the roof than the first course. The shingles are placed so that the exposure portion of the second course of shingles overlaps the headlap portion of the first course of shingles. This overlapping continues with successive rows of shingles to the highest point on the area of the roof, i.e., the hip or the ridge.

Hip and ridge shingles applied along a hip or ridge of a roof (i.e., transverse to the courses of shingles). These hip and ridge shingles span a gap or intersection between courses of shingles of roof planes that meet at a hip or ridge. These hip and ridge shingles are typically applied along the hip or ridge in a similar fashion, with the exposure portion of one hip and ridge shingle covering the headlap portion of an adjacent shingle on the hip or ridge. Thus, only the exposure portion of the shingles are exposed to the environment. This overlapping of the shingles causes water to pass from shingles on higher courses to shingles on the next lowest course of shingles without contacting the substrate. Accordingly, water passes from shingle to shingle and off the roof without contacting the substrate or entering the structure.

Attaching the shingles to the roof is typically achieved by the use of nails or other fastening devices that pass through the shingles and into or through the substrate. The fastening devices are typically placed through the headlap portion of the shingles so that they are overlapped by shingles in an adjacent higher course as described above. This placement of the fasteners prevents water from entering the structure through holes caused by the fasteners.

Some roofs have a membrane (i.e., an underlayment) located between the substrate and the shingles. The membrane may, as an example, be conventional tar paper or other underlayment material that is nailed to the substrate. Strips of the membrane are typically attached to the roof in an overlapping fashion wherein an upper strip overlaps its adjacent lower strip. Accordingly, the membrane serves to shield the substrate from water should a shingle become damaged. For example, if a shingle becomes cracked or otherwise leaks, water will contact the membrane rather than the substrate. Water will then pass along the membrane without contacting the substrate or entering the structure.

SUMMARY

Exemplary embodiments of shingles are disclosed herein.

An exemplary laminated shingle includes an overlay sheet having a top overlay surface, a bottom overlay surface, a headlap portion, and a tab portion arranged between two-cutouts. The shingle also includes an underlay sheet having a top underlay surface and a bottom underlay surface. The overlay sheet is attached to the underlay sheet such that a portion of the top underlay surface is exposed on a first side of the tab portion and a portion of the top underlay surface is exposed on a second side of the tab portion.

Another exemplary laminated shingle includes an overlay sheet having a top overlay surface, a bottom overlay surface, a headlap portion, and a cut-out arranged between two tab portions. The shingle also includes an underlay sheet having a top underlay surface and a bottom underlay surface. The overlay sheet is attached to the underlay sheet such that a portion of the top underlay surface is exposed between the first and second tab portions.

Still another exemplary laminated shingle includes an overlay sheet having a top overlay surface, a bottom overlay surface, a headlap portion, at least one tab portion, and at least one cut-out. The shingle also includes an underlay sheet having a top underlay surface and a bottom underlay surface. The overlay sheet is attached to the underlay sheet such that a portion of the top underlay surface is exposed adjacent the at least one tab portion.

BRIEF DESCRIPTION OF THE DRAWINGS

These and other features and advantages of the present invention will become better understood with regard to the following description and accompanying drawings in which.

DETAILED DESCRIPTION

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements. Also as described herein, the terms "substantially" and "about" are defined as at least close to (and includes) a given value or state (preferably within 10% of, more preferably within 1% of, and most preferably within 0.1% of)

Figure 1:
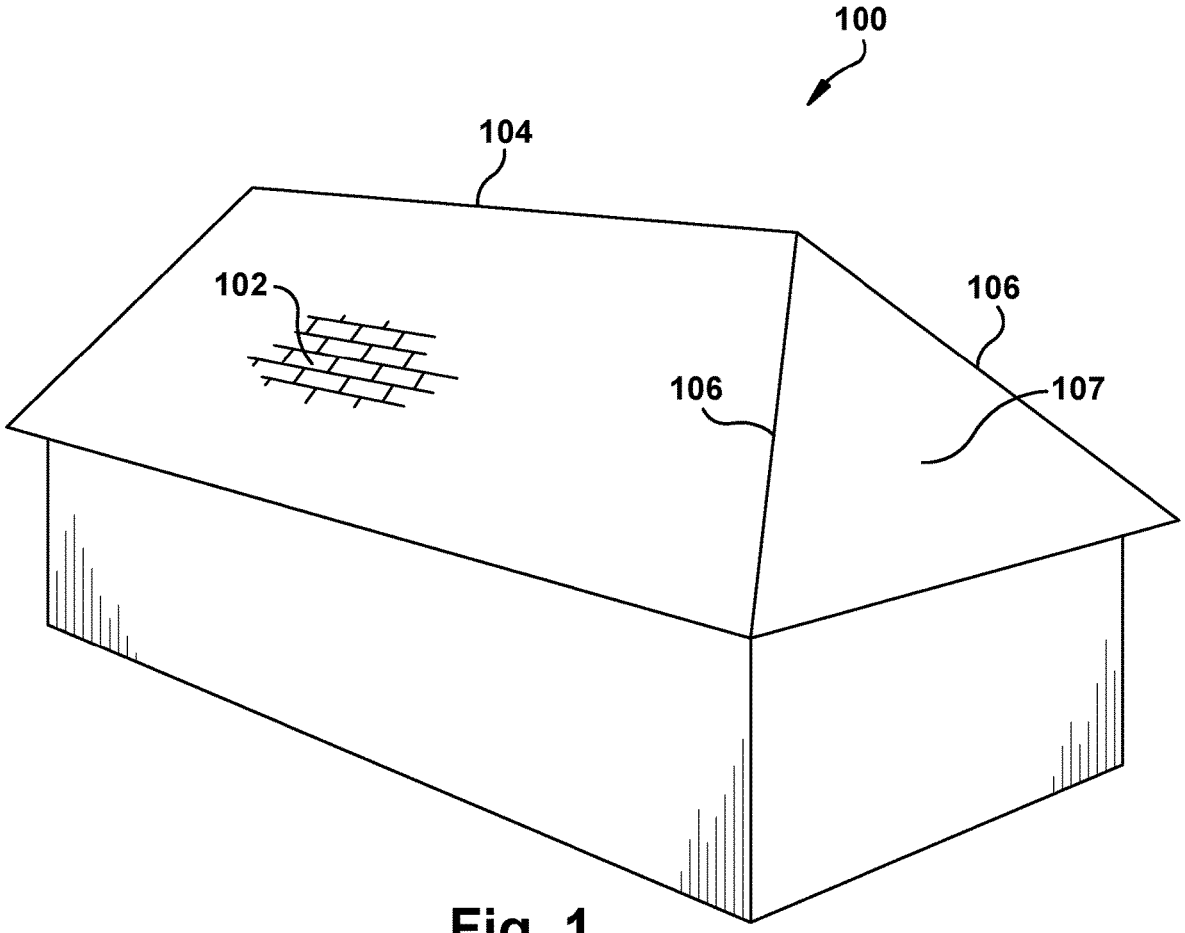
FIG. 1 is a perspective diagram of a roof of a residential home.
Figure 2:
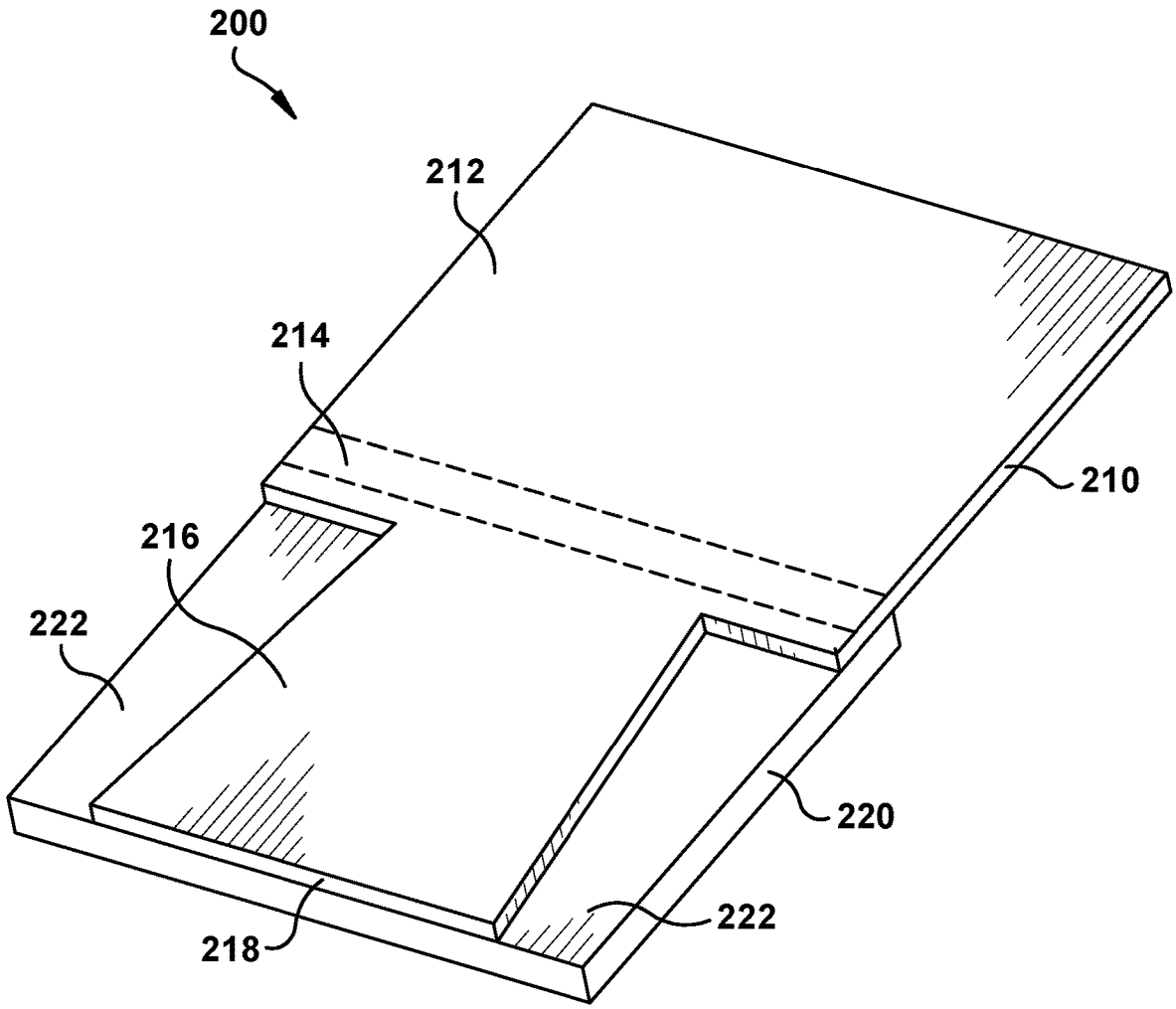
FIG. 2 is a perspective view of an exemplary hip and ridge shingle.

Referring now to FIG. 1, a diagram of a roof structure 100 is shown. The roof 100 is a shingled roof, covered with individual shingles 102. The sides of the roof 100 come together to form a ridge 104 at the top of the roof 100. Hips 106 are formed when an inclined roof plane 107 meets the sides of the roof, instead of a gable end. The hips 106 extend from the eaves of the roof to the ridge 104. The shingles 102 of the roof 100 are applied in courses on top of an optional underlayment (not shown) and sheeting and/or decking (not shown). The shingles 102 may be single-layer three-tab shingles, or may be laminate shingles, such as the shingles described in U.S. Pat. Nos. 8,430,983 and 9,121,178, which are incorporated herein by reference in their entirety.

Referring now to FIGS. 2-5, an exemplary hip and ridge shingle 200 is shown. The shingle 200 includes an overlay sheet 210 attached to an underlay sheet 220. The overlay sheet 210 has a top overlay surface and a bottom overlay surface and includes a headlap portion 212 and a tab portion 216. The underlay sheet 220 includes a top underlay surface and a bottom underlay surface. The tab portion 216 includes a tab 218 arranged between first and second cut-outs 222 extending from the bottom edge and first and second side edges of the overlay sheet 210 that expose the underlay sheet 220. The overlay sheet 210 may optionally include a nail zone 214 that may optionally be reinforced with reinforcement tape or any other material suitable for improving the strength of the shingle to resist nail pull through. An attachment portion attaches the overlay sheet 210 to the underlay sheet 220 by joining at least a portion of a contact area formed between the bottom overlay surface and the top underlay surface. The overlay sheet 210 may be attached to the underlay sheet 220 using an adhesive or any other suitable attachment means. In some embodiments, the entire contact area between the overlay and underlay sheets 210, 220 is joined with an adhesive. In some embodiments, only portions of the contact area between the overlay and underlay sheets 210, 220 is joined with an adhesive. The tab portion 216 and cut-outs 222 are exposed to the environment when the shingle 200 is installed on a hip or ridge of a roof, while the headlap portion 212 is covered by an adjacent shingle 200.

The overlay sheet 210 is attached to the underlay sheet 220 such that a portion of the top underlay surface is exposed on a first side of the tab portion 216 and a portion of the top underlay surface is exposed on a second side of the tab portion 216. The first and second cut-outs 222 can have the same or different widths. In some embodiments, the widths of the first and second cut-outs 222 range from about 5 percent to about 30 percent, or about 10 percent to about 25 percent, or about 15 percent to about 20 percent of a width of the shingle or any sub-range thereof.

Figure 3:
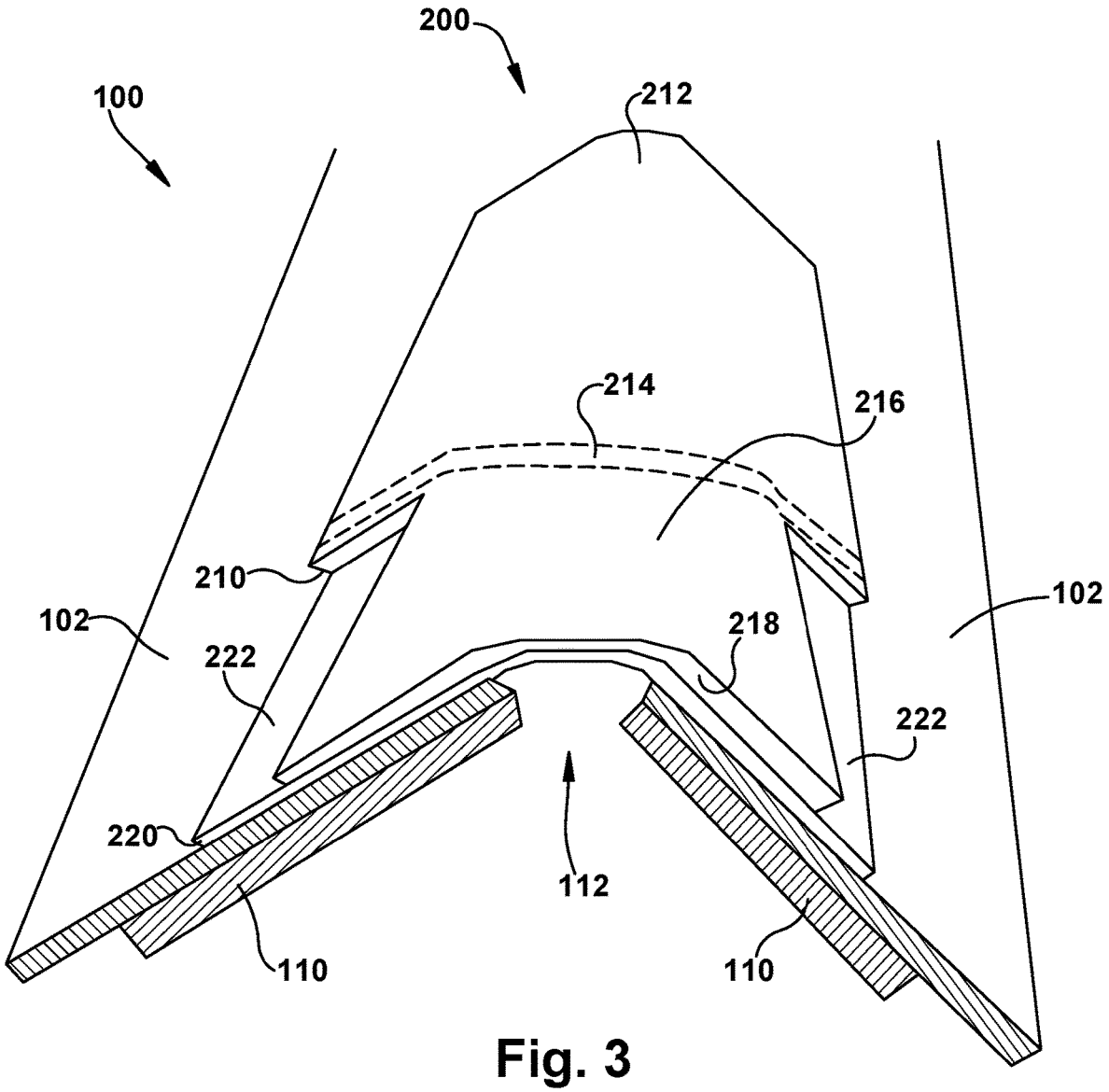
FIG. 3 is a perspective view of an exemplary hip and ridge shingle applied to a hip or ridge of a roof.

Referring now to FIG. 3, an exemplary hip and ridge shingle 200 is shown installed on the hip 104 the roof 100. An optional gap 112 is formed between sheeting 110 of each side of the roof 100 to allow air to flow out from the roof for ventilation. Shingles 102 cover the sheeting 110 up to the edge of the gap 112. An exemplary hip and ridge shingle 200 is bent to cover the gap 112 and is attached to each side of the roof 100. The shingle 200 may be attached to the roof 100 by any suitable means, such as, for example, adhesive, nails, screws, staples, sealant, or other fastening devices. In some embodiments, a ridge vent (not shown) is installed between the hip and ridge shingle 200 and the roof 100.

A radius of the bend formed in the shingle 200 when applied over the hip or ridge of the roof 100 varies based on the pitch of the sides of the roof 100. The shingles 200 will be bent more and with a smaller bend radius to cover the ridge of a steep roof, and will be bent less with a larger bend radius to cover the ridge of a shallow roof. As the shingle 200 is bent, the overlay sheet 210 may shift relative to the underlay sheet 220 as the bend radius for each sheet is slightly different, and the length along the arc formed by the bent shingle 200 varies with the difference in radius. Consequently, the underlay sheet 220 shifts outward from the center of the bend in the shingle 200 relative to the overlay sheet 210 as the shingle 200 is bent. The attachment portion that attaches the overlay and underlay sheets 210, 220 to each other allows movement between the sheets 210, 220. In some embodiments, the overlay and underlay sheets 210, 220 are attached in a center portion of the shingle 200 to allow movement between the sheets 210, 220 when the shingle is bent. In some embodiments, a flexible adhesive is used to allow for relative movement of the sheets 210, 220 without separation.

Figure 4:
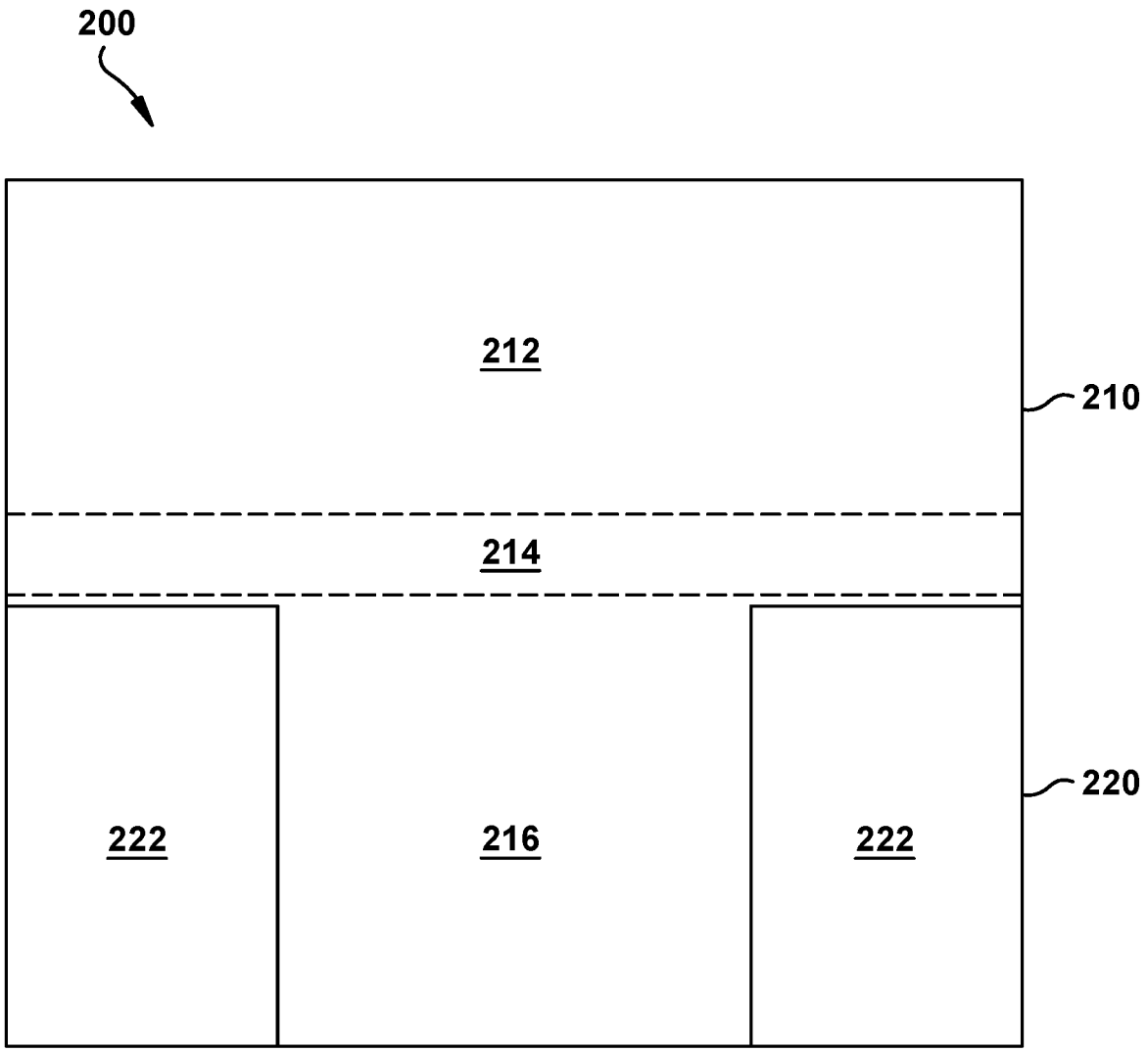
FIG. 4 is a top plan view of an exemplary hip and ridge shingle.
Figure 5:
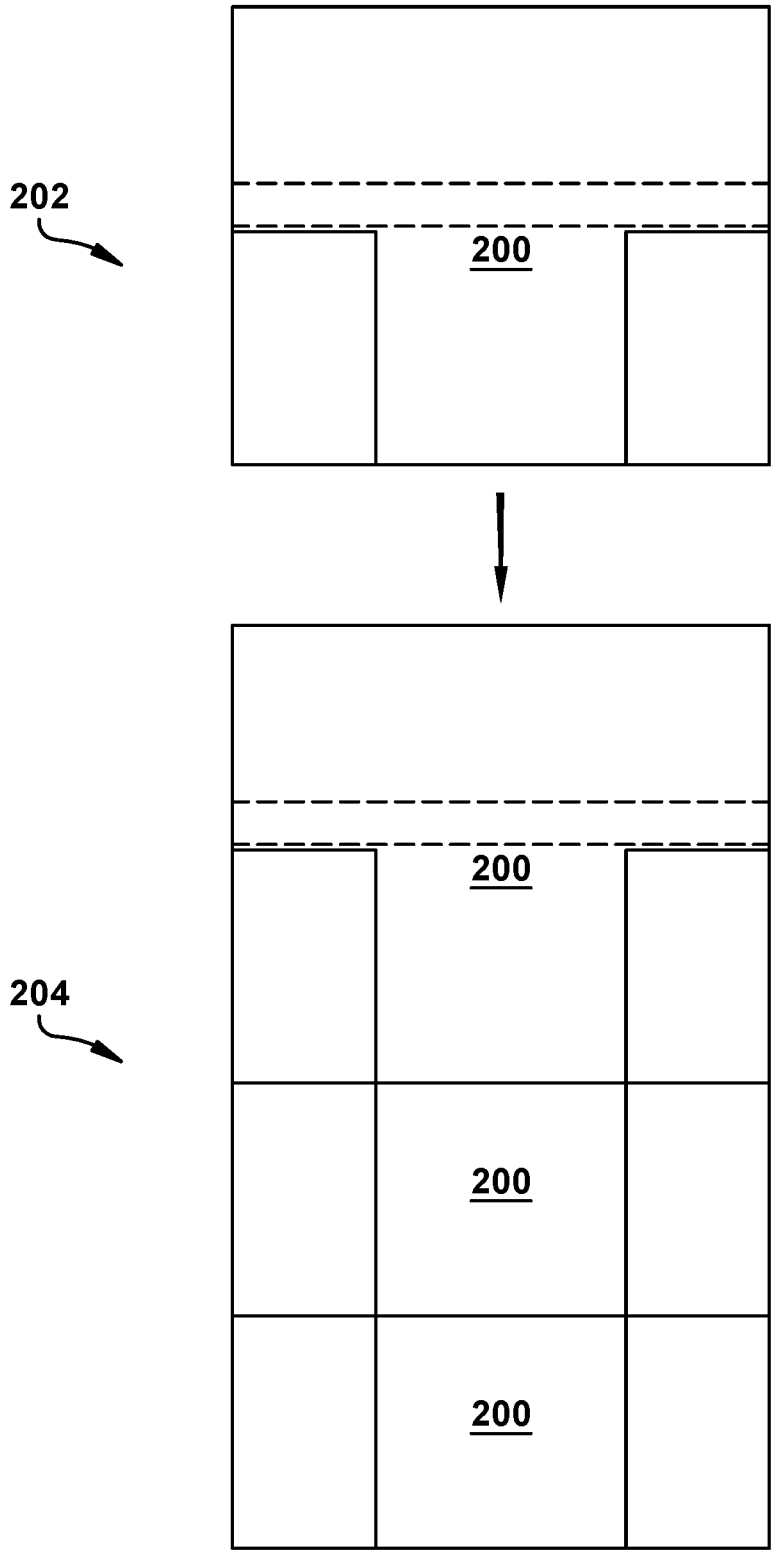
FIG. 5 is a top plan view of a plurality of exemplary hip and ridge shingles.
Figure 6:
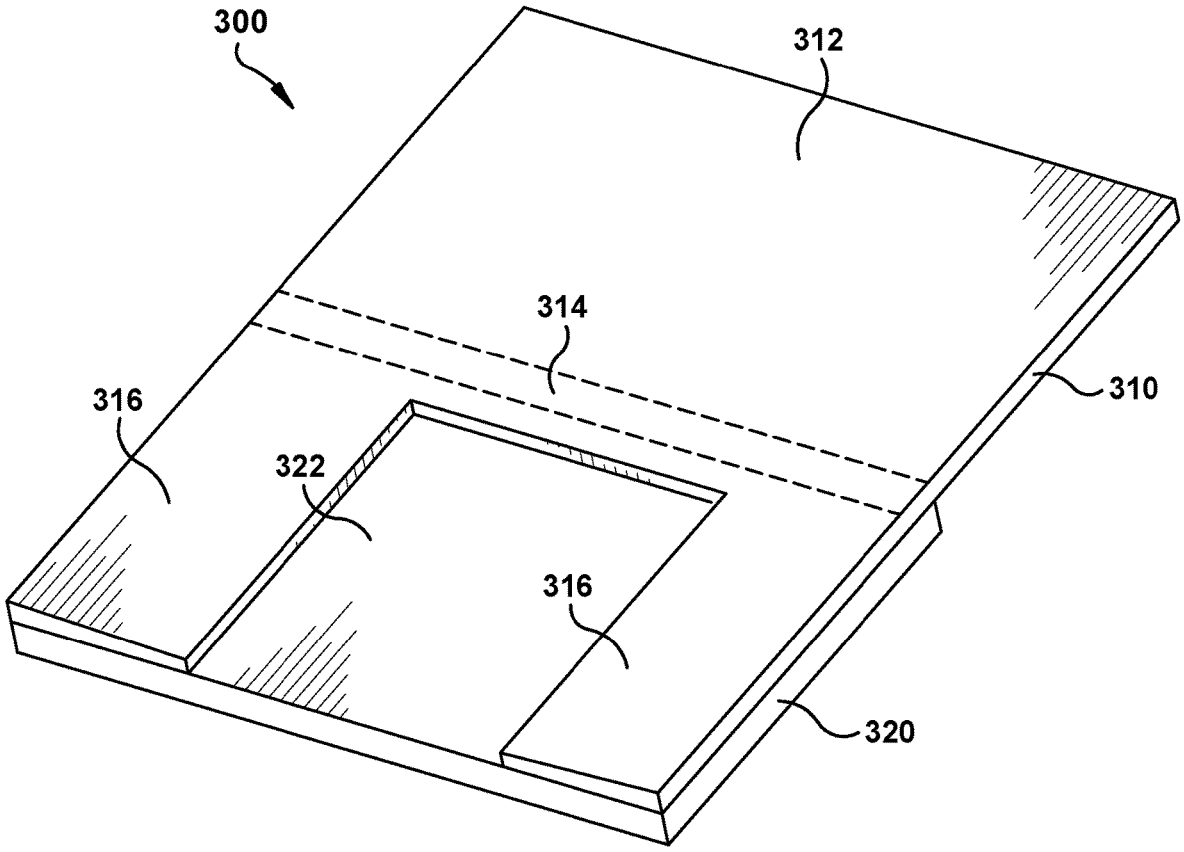
FIG. 6 is a perspective view of an exemplary hip and ridge shingle.

Referring now to FIGS. 4 and 5, exemplary hip and ridge shingles 200 are shown from a top plan view. While the tab portion 216 is shown with a rectangular shape, the edges of the tab portion 216 may have any profile, thereby giving the tab a different shape, such as, for example, a keystone shape or a dovetail shape. As can be seen in FIG. 5, the hip and ridge shingles 200 are overlapped as they are applied to the hip 106 or ridge 104 of a roof 100. Each successive shingle 200 is applied such that the tab portion 216 of the shingle being applied 202 covers the headlap portion 212 and nail zone 214 of the already applied shingles 204. An adhesive (not shown) may be applied to the shingles in the headlap portion 212 or the nail zone 214 so that the tab portion 216 of the newly applied shingle 202 adheres to the already applied shingles 204 and does not lift up when exposed to wind or debris.

Referring now to FIGS. 6-9, an exemplary hip and ridge shingle 300 is shown. The shingle 300 includes an overlay sheet 310 attached to an underlay sheet 320. The overlay sheet 310 has a top overlay surface and a bottom overlay surface and includes a headlap portion 312 and a tab portion 316. The underlay sheet 320 includes a top underlay surface and a bottom underlay surface. The tab portion 316 includes tab 318 spaced apart by a cut-out 322 extending from the bottom edge of the overlay sheet 310 that exposes the underlay sheet 320. The overlay sheet 310 may optionally include a nail zone 314 that may be reinforced with reinforcement tape or any other material suitable for improving the strength of the shingle to resist nail pull through. An attachment portion attaches the overlay sheet 310 to the underlay sheet 320 by joining at least a portion of a contact area formed between the bottom overlay surface and the top underlay surface. The overlay sheet 310 may be attached to the underlay sheet 320 using an adhesive or any other suitable attachment means. In some embodiments, the entire contact area between the overlay and underlay sheets 310, 320 is joined with an adhesive. In some embodiments, only portions of the contact area between the overlay and underlay sheets 310, 320 is joined with an adhesive. The tab portions 316 and cut-out 322 are exposed to the environment when the shingle 300 is installed on a hip or ridge of a roof, while the headlap portion 312 is covered by an adjacent shingle 300.

The overlay sheet 310 is attached to the underlay sheet 320 such that a portion of the top underlay surface is exposed between the first and second tabs 318. The cut-out 322 has a width ranging from about 5 percent to about 75 percent, or about 20 percent to about 75 percent, or about 15 percent to about 60 percent, or about or about 30 percent to about 65 percent, or about 25 percent to about 40 percent, or about 40 percent to about 55 percent of a width of the shingle or any sub-range thereof.

Figure 7:
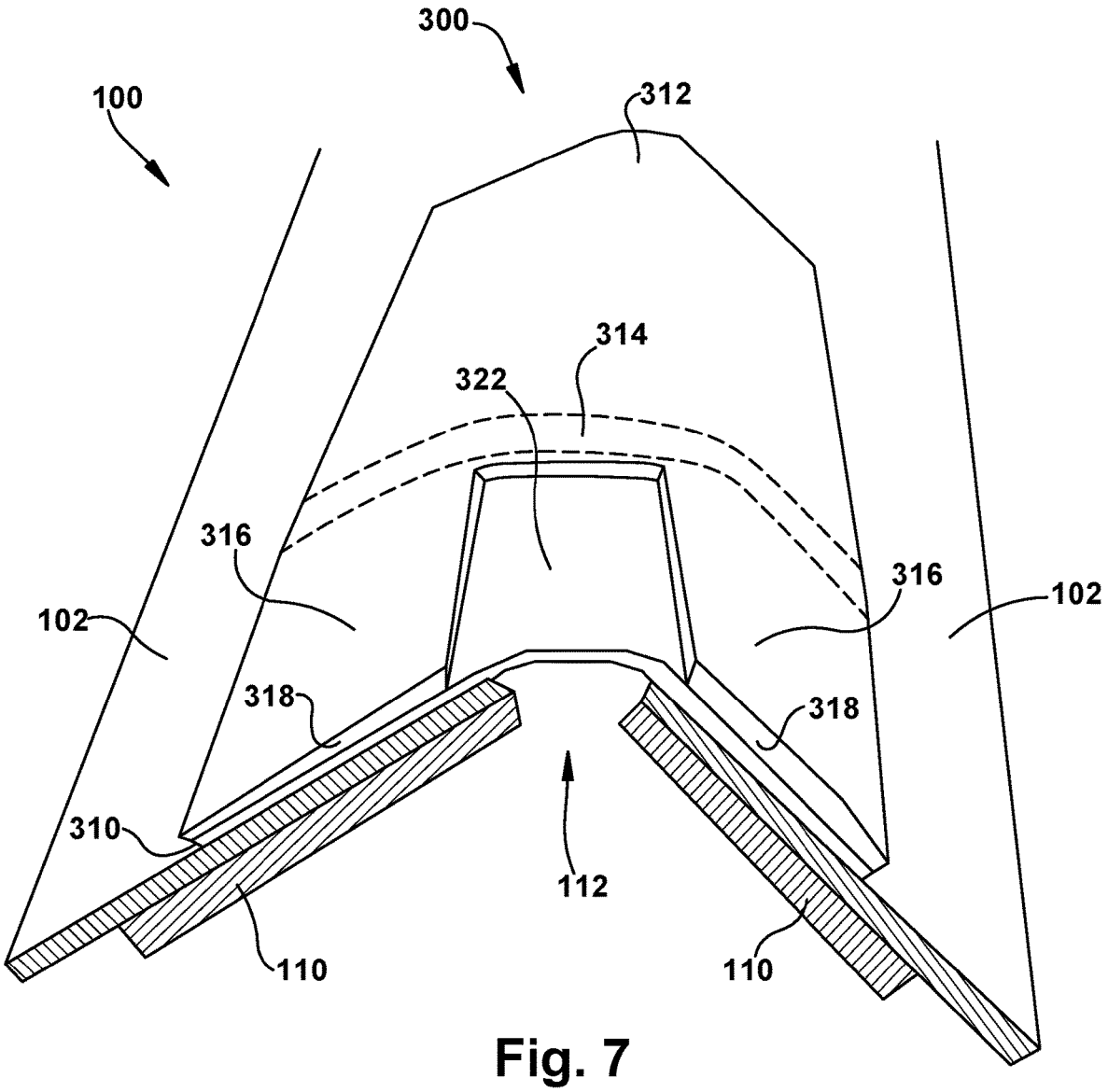
FIG. 7 is a perspective view of an exemplary hip and ridge shingle applied to a hip or ridge of a roof.

Referring now to FIG. 7, an exemplary hip and ridge shingle 300 is shown installed on the hip 104 the roof 100. A gap 112 is formed between sheeting 110 of each side of the roof 100 to allow air to flow out from the roof for ventilation. Shingles 102 cover the sheeting 110 up to the edge of the gap 112. An exemplary hip and ridge shingle 300 is bent to cover the gap 112 and is attached to each side of the roof 100. The shingle 300 may be attached to the roof 100 by any suitable means, such as, for example, adhesive, nails, sealant, or other fastening devices. In some embodiments, a ridge vent (not shown) is installed between the hip and ridge shingle 300 and the roof 100.

A radius of the bend formed in the shingle 300 when applied over the hip or ridge of the roof 100 varies based on the pitch of the sides of the roof 100. The shingles 300 will be bent more and with a smaller bend radius to cover the ridge of a steep roof, and will be bent less with a larger bend radius to cover the ridge of a shallow roof. As the shingle 300 is bent, the overlay sheet 310 may shift relative to the underlay sheet 320 as the bend radius for each sheet is slightly different, and the length along the arc formed by the bent shingle 300 varies with the difference in radius. Consequently, the underlay sheet 320 shifts outward from the center of the bend in the shingle 300 relative to the overlay sheet 310 as the shingle 300 is bent. The attachment portion that attaches the overlay and underlay sheets 310, 320 to each other allows movement between the sheets 310, 320. In some embodiments, the overlay and underlay sheets 310, 320 are attached in a center portion of the shingle 300 to allow movement between the sheets 310, 320 when the shingle is bent. In some embodiments, a flexible adhesive is used to allow for relative movement of the sheets 310, 320 without separation.

Figure 8:
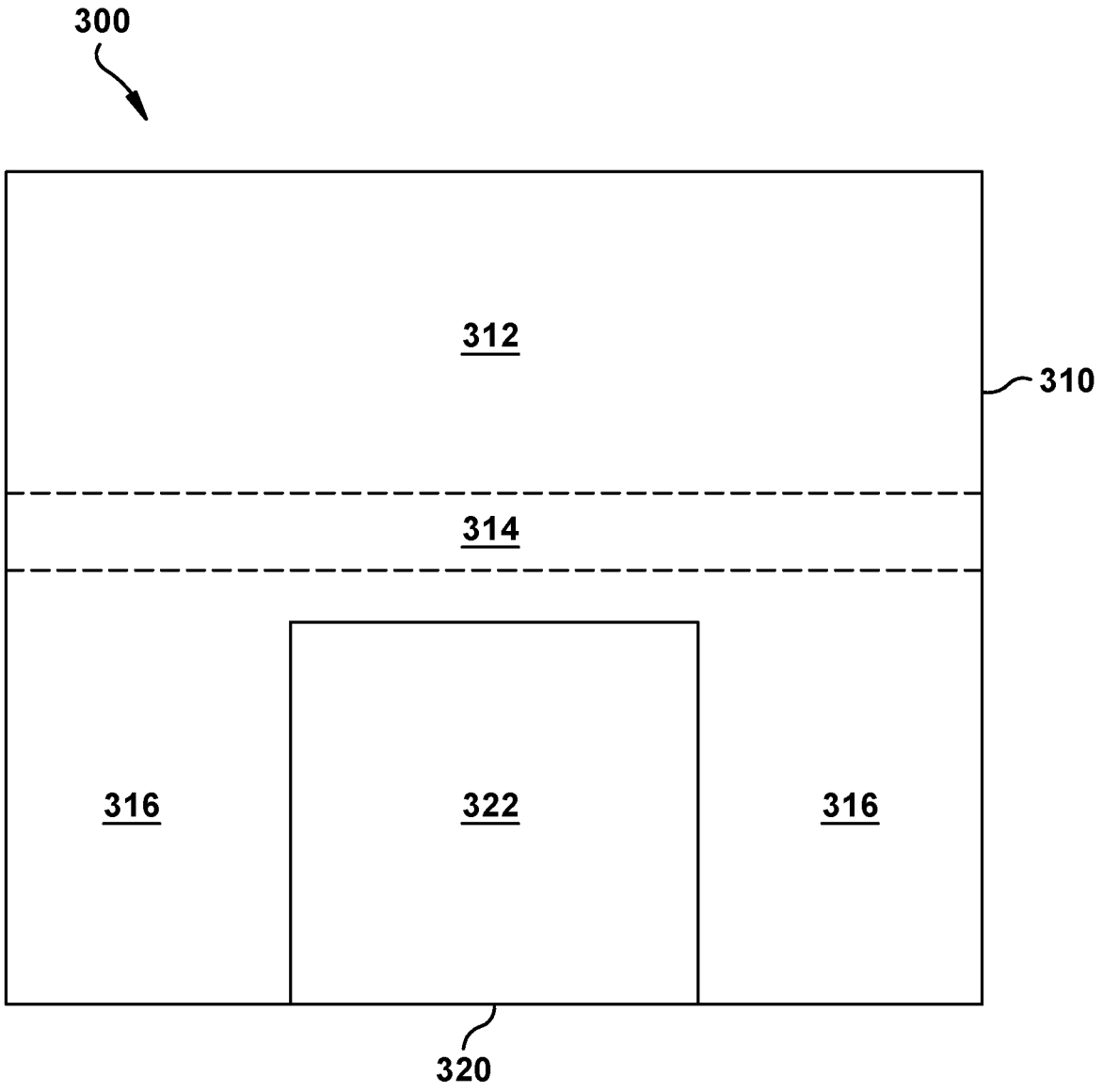
FIG. 8 is a top plan view of an exemplary hip and ridge shingle.
Figure 9:
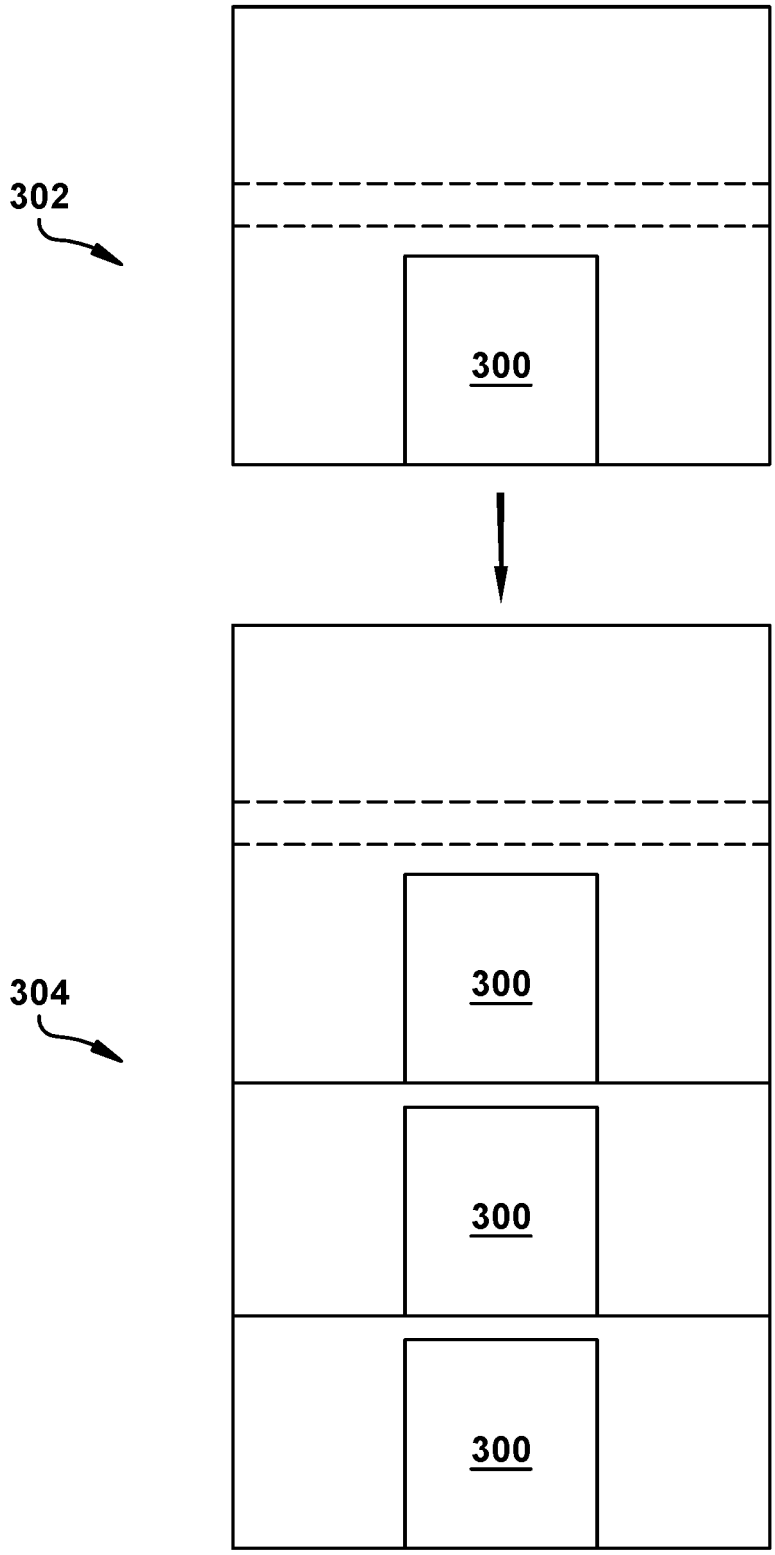
FIG. 9 is a top plan view of a plurality of exemplary hip and ridge shingles.

Referring now to FIGS. 8 and 9, exemplary hip and ridge shingles 300 are shown from a top plan view. While the tab portion 316 is shown with a rectangular shape, the edges of the tab portion 316 may have any profile, thereby giving the tab a different shape, such as, for example, a keystone shape or a dovetail shape. As can be seen in FIG. 5, the hip and ridge shingles 300 are overlapped as they are applied to the hip 106 or ridge 104 of a roof 100. Each successive shingle 300 is applied such that the tab portion 316 of the shingle being applied 302 covers the headlap portion 312 and nail zone 314 of the already applied shingles 304. An adhesive (not shown) may be applied to the shingles in the headlap portion 312 or the nail zone 314 so that the tab portion 316 of the newly applied shingle 302 adheres to the already applied shingles 304 and does not lift up when exposed to wind or debris.

Figure 10:
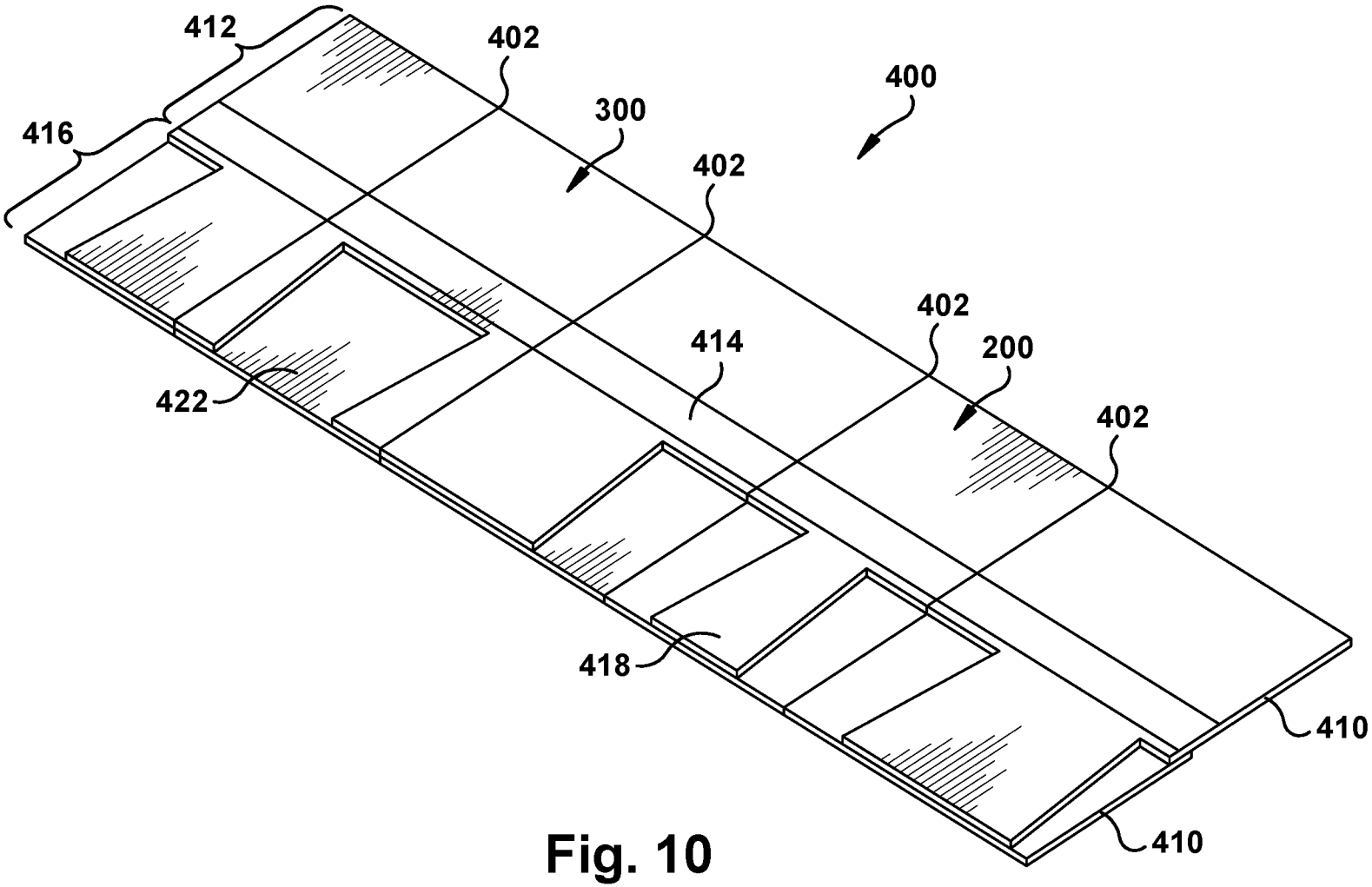
FIG. 10 illustrates an exemplary embodiment of a multi-tab laminated shingle cut to form one or more hip and ridge shingles.

Referring now to FIG. 10, a traditional laminated shingle strip is shown. The shingle strip 400 includes an overlay sheet 410 attached to an underlay sheet 420. The overlay sheet 410 includes a headlap portion 412 and a tab portion 416. The tab portion 416 includes alternating tabs 418 and cut-outs 422 that expose the underlay sheet 420. The overlay sheet 410 may optionally include a nail zone 414 that may be reinforced with reinforcement tape or any other material suitable for improving the strength of the shingle to resist nail pull through. The overlay sheet 410 may be attached to the underlay sheet 420 using an adhesive or any other suitable attachment means. In some embodiments, the entire contact area between the overlay and underlay sheets 410, 420 is joined with an adhesive. In some embodiments, only portions of the contact area between the overlay and underlay sheets 410, 420 is joined with an adhesive.

The shingle strip 400 may be cut along cuts 402 to form one or more hip and ridge shingles 200, 300, described above. Cutting the shingle strip 400 along the cuts 402 may be performed manually or may be performed online, without removing the shingle strip 400 from the manufacturing line. Cutting the shingle strip 400 into individual shingles 200, 300 online reduces the time, cost, and capital investment needed to make individual hip and ridge shingles 200, 300. In some embodiments, the tabs 418 and cut-outs 422 are uniform in size so that each cut produces a uniform individual hip and ridge shingle 200, 300. (As opposed to the illustrated, non-uniform shingle.) The tabs 418 and cut-outs 422 can be any size or shape desired in the individual shingles 200, 300.

While various inventive aspects, concepts and features of the disclosures may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts and features of the disclosures—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present application even if such embodiments are not expressly disclosed herein. Additionally, even though some features, concepts or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of an disclosure, such identification is not intended to be exclusive, but rather there may be inventive aspects, concepts and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A roof shingle system for covering a roof, the roof shingle system comprising:

a plurality of laminated shingles comprising:

an overlay sheet extending from a first edge to a second edge, the overlay sheet comprising a top overlay surface, a bottom overlay surface, a headlap portion, a single tab, a first cut-out, and a second cut-out, wherein the first cut-out extends from the first edge to the single tab, the single tab extends from the first cut-out to the second cut-out, and the second cut-out extends from the single tab to the second edge, and wherein a width of the first cut-out is the same as a width of the second cut-out; and an underlay sheet comprising a top underlay surface and a bottom underlay surface, the underlay sheet being attached to the overlay sheet in a center portion of the laminated shingle such that a portion of the top underlay surface is exposed on a first side of the single tab and a portion of the top underlay surface is exposed on a second side of the single tab and the first and second edges of the overlay sheet are allowed to move relative to the underlay sheet during bending of the laminated shingle;

a first course of one laminated shingle arranged on the roof, wherein the single tab is bent along a hip or a ridge of the roof and the first and second cut-outs lay flat on adjacent portions of the roof;

a second course of one laminated shingle overlaying the headlap portion of the laminated shingle of the first course, wherein the single tab is bent along the hip or the ridge of the roof and the first and second cut-outs lay flat on adjacent portions of the roof;

wherein the single tab of the second course laminated shingle is aligned with the single tab of the first course laminated shingle and the first and second edges of the second course laminated shingle are aligned with the first and second edges of the first course laminated shingle.

2. The roof shingle system of claim 1, wherein the first cut-out has a cut-out width ranging from about 5 percent to about 30 percent of a width of the shingle, and wherein the second cut-out has a cut-out width ranging from about 5 percent to about 30 percent of a width of the shingle.

3. The roof shingle system of claim 1, wherein the first cut-out has a cut-out width ranging from about 10 percent to about 25 percent of a width of the shingle, and wherein the second cut-out has a cut-out width ranging from about 10 percent to about 25 percent of a width of the shingle.

4. The roof shingle system of claim 1, wherein the first cut-out has a cut-out width ranging from about 15 percent to about 20 percent of a width of the shingle, and wherein the second cut-out has a cut-out width ranging from about 15 percent to about 20 percent of a width of the shingle.

5. The roof shingle system of claim 1, wherein the cut-outs extend from a bottom overlay edge and from first and second overlay side edges, respectively.

6. The roof shingle system of claim 1, wherein the overlay sheet further comprises a nail zone reinforced with reinforcement tape.

7. A roof shingle system for covering a roof, the roof shingle system comprising:

a plurality of laminated shingles comprising:

an overlay sheet extending from a first edge to a second edge, the overlay sheet comprising a top overlay surface, a bottom overlay surface, a headlap portion, a single cut-out, a first tab, and a second tab, wherein the first tab extends from the first edge to the single cut-out, the single cut-out extends from the first tab to the second tab, and the second tab extends from the single cut-out to the second edge, and wherein a width of the first tab is the same as a width of the second tab; and an underlay sheet comprising a top underlay surface and a bottom underlay surface, the underlay sheet being attached to the overlay sheet in a center portion of the laminated shingle such that a portion of the top underlay surface is exposed between the first and second tabs and the first and second edges of the overlay sheet are allowed to move relative to the underlay sheet during bending of the laminated shingle;

a first course of one laminated shingle arranged on the roof, wherein the single cut-out is bent along a hip or a ridge of the roof and the first and second tabs lay flat on adjacent portions of the roof;

a second course of one laminated shingle overlaying the headlap portion of the laminated shingle of the first course, wherein the single cut-out is bent along the hip or the ridge of the roof and the first and second tabs lay flat on adjacent portions of the roof;

wherein the single cut-out of the second course laminated shingle is aligned with the single cut-out of the first course laminated shingle and the first and second edges of the second course laminated shingle are aligned with the first and second edges of the first course laminated shingle.

8. The roof shingle system of claim 7, wherein the cut-out has a cut-out width ranging from about 20 percent to about 75 percent of a width of the shingle.

9. The roof shingle system of claim 7, wherein the cut-out has a cut-out width ranging from about 30 percent to about 65 percent of a width of the shingle.

10. The roof shingle system of claim 7, wherein the cut-out has a cut-out width ranging from about 40 percent to about 55 percent of a width of the shingle.

11. The roof shingle system of claim 7, wherein the cut-out extends from a bottom overlay edge.

12. The roof shingle system of claim 7, wherein the overlay sheet further comprises a nail zone reinforced with reinforcement tape.

13. A roof shingle system for covering a roof, the roof shingle system comprising:

a plurality of laminated shingles comprising:

an overlay sheet extending from a first edge to a second edge, the overlay sheet comprising a top overlay surface, a bottom overlay surface, a headlap portion, at least one tab, and at least one cut-out, wherein a first section of the shingle extends from the first edge to a second section, the second section extends from the first section to a third section, and the third section extends from the second section to the second edge, and wherein a width of the first section is the same as a width of the third section; and an underlay sheet comprising a top underlay surface and a bottom underlay surface;

wherein the at least one tab is formed in the first and third sections or in the second section, and the at least one cut-out is formed in the second section when the at least one tab is formed in the first and third sections or in the first and third sections when the at least one tab is formed in the second section; and wherein the overlay sheet is attached to the underlay sheet in a center portion of the laminated shingle such that a portion of the top underlay surface is exposed in the second section when the at least one tab is formed in the first and third sections or in the first and third sections when the at least one tab is formed in the second section and the first and second edges of the overlay sheet are allowed to move relative to the underlay sheet during bending of the laminated shingle;

a first course of one laminated shingle arranged on the roof, wherein the second section is bent along a hip or a ridge of the roof and the first and third sections lay flat on adjacent portions of the roof;

a second course of one laminated shingle overlaying the headlap portion of the laminated shingle of the first course, wherein the second section is bent along the hip or the ridge of the roof and the first and third sections lay flat on adjacent portions of the roof;

wherein the second section of the second course laminated shingle is aligned with the second section of the first course laminated shingle and the first and second edges of the second course laminated shingle are aligned with the first and second edges of the first course laminated shingle.

14. The roof shingle system of claim 13, wherein the at least one cut-out has a cut-out width ranging from about 5 percent to about 75 percent of a width of the shingle.

15. The roof shingle system of claim 13 wherein the at least one cut-out has a cut-out width ranging from about 20 percent to about 75 percent of a width of the shingle.

16. The roof shingle system of claim 13, wherein the at least one cut-out has a cut-out width ranging from about 5 percent to about 30 percent of a width of the shingle.

17. The roof shingle system of claim 13, wherein the at least one cut-out has a cut-out width ranging from about 15 percent to about 60 percent of a width of the shingle.

18. The roof shingle system of claim 13, wherein the at least one cut-out has a cut-out width ranging from about 25 percent to about 40 percent of a width of the shingle.

19. The roof shingle system of claim 13, wherein the at least one cut-out extends from at least one of a bottom overlay edge and a side overlay edge.

20. The roof shingle system of claim 13, wherein the overlay sheet further comprises a nail zone reinforced with reinforcement tape.

* * * * *